United States Patent [19]

Moore et al.

[11] Patent Number: 4,717,214

[45] Date of Patent: Jan. 5, 1988

[54] MODULAR DRESSING TABLE AND DEMOUNTABLE MODULES THEREFOR

[75] Inventors: Donald L. Moore, Columbus, Ind.; Raymond Spilman, Darien; Thomas Pendleton, Wilton, both of Conn.

[73] Assignee: Cosco, Inc., Columbus, Ind.

[21] Appl. No.: 699,997

[22] Filed: Feb. 8, 1985

[51] Int. Cl.[4] ..... A47B 87/00

[52] U.S. Cl. ..... 312/107; 220/7; 312/258; 446/487

[58] Field of Search ..... 312/107, 108, 111, 263, 312/264, 265, 257 R, 258; 16/DIG. 13, 262, 267, 365, 366, 370, 386; 220/6, 7; 446/482, 487; 4/572, 585, 586

[56] References Cited

U.S. PATENT DOCUMENTS

| | | | |
|---|---|---|---|
| 1,212,429 | 1/1917 | Weinstein | 312/258 |
| 2,281,629 | 5/1952 | Snow | 4/572 |
| 2,550,088 | 4/1951 | Sayer | 220/6 |
| 3,254,786 | 6/1966 | Melville | 220/6 |
| 3,655,065 | 4/1972 | Yellin | 312/107 |
| 4,181,236 | 1/1980 | Prodel | 220/7 |

*Primary Examiner*—Peter A. Aschenbrenner
*Assistant Examiner*—Gerald A. Anderson
*Attorney, Agent, or Firm*—Barnes & Thornburg

[57] ABSTRACT

Hingedly connected rectangular panels are used to construct demountable module assemblies useful alone or in combination as multifunctional furniture items. A modular dressing table includes four such module assemblies secured in a two-by-two matrix, and a restraint belt and pad affixed to the top of the matrix. The module assemblies are provided with an aperture to allow user access to the interior space of said assemblies for storage.

7 Claims, 16 Drawing Figures

MODULAR DRESSING TABLE AND DEMOUNTABLE MODULES THEREFOR

This invention relates to a modular dressing table for an infant comprised of a matrix of novel, demountable modules which can be used individually, or collectively in alternate module arrangements, as multifunctional household furnishings.

Typically juvenile room furnishings, especially juvenile furniture items purchased to facilitate parental care of infants, have a limited useful life for the original purchaser. Infants soon grow into toddlers and then into young men and women. As children grow their needs change—from the cradle to the crib to the rubber mattressed twin bed. The baby's dressing table, once used seemingly on an hourly basis, soon stands in a corner of the toddler's room only as a temporary resting place for dirty clothes and as a last resting place for the clothes he too quickly outgrew. While it is often the case that the dressing table is again pressed into daily service with the birth of one or more younger siblings, inevitably junior's dressing table, no longer serving the furnishing needs of the family, finds its way first into the closet, then to the garage or attic and from there by garage sale or gift to another.

An infant's dressing table which is convertible into a multiplicity of functional room furnishings adapted to meet the needs of children through pre-school and school age would offer obvious advantages. Not only would it enhance the value of the original investment by prolonging the useful life of the table (or specifically its components), but it would also reduce or eliminate the need to purchase additional juvenile furnishings as the infant for whom the table was originally purchased grows from infancy through the toddler stage and onto the pre-school and school-age stages of childhood.

Accordingly it is an object of this invention to provide a modular dressing table for an infant comprised of independent rectangular-solid-shaped assemblies which can be used individually, or collectively in alternate modular configurations, as multifunctional room furnishings.

It is another object of this invention to provide a dressing table comprised of discrete module assemblies reversibly secured in a close adjacent relationship wherein each of said assemblies provide discrete storage compartments.

A further object of this invention is to provide a demountable module assembly which can be utilized individually or in combination with other like assemblies to provide multifunctional room furnishings.

It is still a further object of this invention to provide rectangular shaped panels which can be hingedly connected to form the walls of module assemblies useful for the construction of juvenile furniture items. These and other objects will be readily apparent from the following description of the invention.

This invention is directed to a demountable modular dressing table for an infant, module assemblies which can be used to construct such a dressing table and rectangular panels useful for the construction of said module assemblies.

The modular dressing table of the present invention is designed for use in the care of an infant. It has a top surface and a bottom surface and is comprised of a matrix element of individual module assemblies, each assembly being reversibly secured to each adjacent assembly in the matrix. An infant restraining means for safety and a cushion means for comforting said infant are secured to the top surface of the table. Optionally at least four, preferably eight, floor-contacting table support means (feet) can be affixed to the bottom surface of the table.

The individual module assemblies used for the construction of the present modular dressing table are preferably rectangular-solid-shaped assemblies sized and arranged in a matrix configuration to present a top surface at a height convenient for use as a dressing surface for an infant. The individual module assemblies in the assembly matrix are secured to adjacent assemblies in the matrix. While the size, and concomitantly the number, of the assemblies used in the matrix is not critical to the present invention, it is preferred that the module assemblies be sized so that the matrix element of the present dressing table can be comprised conveniently of from two to about eight module assemblies.

The module assemblies which in combination form the matrix element of the present modular dressing table are preferably hollow and of rigid-wall construction. It is preferred that at least one side of each of the module assemblies has an aperture sized to allow user access to the interior space of said assembly. With such an aperture the module assemblies can each serve as a storage compartment in addition to its function as a structural member in the matrix element of the present modular dressing table.

Each of the module assemblies forming the matrix element are reversibly secured to each adjacent assembly in the matrix. The matrix element can be demounted into its component module assemblies. The assemblies can thereafter be used individually or collectively in alternate matrix configurations to meet different juvenile furnishing needs.

In an illustrative embodiment of the present invention the module assemblies are provided with uniformly positioned holes sized and adapted to receive an affixing means such as a snap rivet, screw or nut and bolt combination. The assemblies can be secured to one another in the matrix by aligning the affixing means receiving holes of adjacent module assemblies and inserting the affixing means. Likewise the floor contacting table support means, the restraining means, and cushion means are provided with affixing means receiving holes which can be aligned with a plurality of affixing means receiving holes in the modular assemblies collectively forming the respective top and bottom surfaces of the matrix.

In accordance with a preferred illustrative embodiment of the present invention the module assembly components of the matrix element of the present modular dressing table are comprised of hingedly connected rectangular panels and a means for engaging said hingedly connected rectangular panels to hold each panel rigidly in a fixed position relative to panels connected therewith. Each panel has first and second opposite panel engaging edges and third and fourth opposite lateral edges. The first panel engaging edge is formed as a first connector and the second panel engaging edge is formed as a second connector which is reversibly engageable with a first connector formed at the first edge of another like rectangular panel to hingedly connect said panels along their respective first and second edges. The module assemblies are thus comprised of said rectangular panels, the first edge of each hingedly connected to the second edge of another and a means for engaging said hingedly connected rectangular panels to hold each panel rigidly in a fixed position relative to adjacent panels connected therewith.

In a preferred embodiment of the present invention the module assemblies comprising the matrix element of the present modular dressing table consists essentially of four of said hingedly connected panels and a means for engaging said panels to hold each in a position perpendicular to the panels connected therewith. This is accomplished preferably by a panel support member sized to engage the four hingedly connected rectangular panels proximal to their respective adjacent lateral edges and means for securing said support member to said hinged rectangular panels. The hingedly connected rectangular panels are preferably formed to have a support member receiving surface at each of their opposite lateral edges so that the adjacent lateral edges of the hingedly connected panels collectively define a rectangular shaped receiving surface for a panel support member. The support member can be reversibly affixed to said receiving surface using reversible affixing means or securing means such as snap rivets, screws, and nut and bolt combinations. Alternatively, the hingedly connected panels can be provided with a means for engaging a panel support member cooperatively positioned with said support member receiving surface to hold said support member in a close relationship with the support member receiving surface without need for additional means for securing the panel support member to the hingedly connected rectangular panels. The panel support members are conveniently provided with an aperture to allow user access to the interior space of said assembly .

Exemplary of the first and second panel connectors engageable to hingedly connect said rectangular panels is a first connector comprised of a hinge post supported in a position substantially parallel to the first edge of the rectangular panel and a second connector at the opposite edge of said rectangular panel formed as a hinge post receiving channel.

The hingedly connected rectangular panels forming the present module assembly, as well as the panel support members, are formed using art recognized molding techniques from any one of a wide variety of synthetic or semi-synthetic plastics or polymeric materials, including preferred high impact polystyrene.

Illustrative of the assemblies which can be reversibly affixed to form the matrix element of the present modular dressing table is an assembly comprised of four of said rectangular panels having opposite hinge post and hinge post receiving channel connectors, engaged to form a construction having four rectangular walls hingedly connected and means for engaging said construction to hold each panel rigidly in a position perpendicular to the adjacent panels engaged therewith. The assembly so constructed has six rectangular sides, four sides of which are formed by the hingedly connected rectangular panels. The perimeter of the fifth and sixth sides of said assembly are defined by the collective adjacent lateral edges of said hingedly connected panels.

In an exemplary embodiment of the present modular dressing table the matrix element consists of four of the above-described rectangular-solid-shaped assemblies in a two-by-two matrix having two upper and two lower horizontally adjacent assemblies. The top surface of the dressing table is formed by the top rectangular panels of the two upper horizontally adjacent assemblies in the matrix while the bottom surface of the dressing table is formed by the bottom rectangular panels of the two lower horizontally adjacent assemblies in the two-by-two matrix.

An infant restraining means, typically a webbed belt construction and a cushion means, typically a cloth-covered or vinyl-covered foam pad are reversibly affixed to the panels forming the top surface of the dressing table. Table support means in the form of feet are affixed to the bottom surface of the dressing table. Conveniently the restraining means, cushioning means and support means are affixed to the matrix of rectangular-solid-shaped assemblies using affixing means positioned in affixing means receiving holes located in the rectangular panels forming the top and bottom surfaces of the matrix.

The modular matrix element of the present modular dressing table is a sturdy but readily demountable construction. The individual module assemblies can be affixed in an alternate module arrangement or configuration to meet other juvenile furnishing needs. Alternatively the module assemblies, formed from hingedly connected rectangular panels and panel support members, can be readily demounted into their panel components for easy storage.

The present invention may best be understood by reference to the following description of a preferred embodiment and the accompanying drawings.

IN THE DRAWINGS

Figure 1:
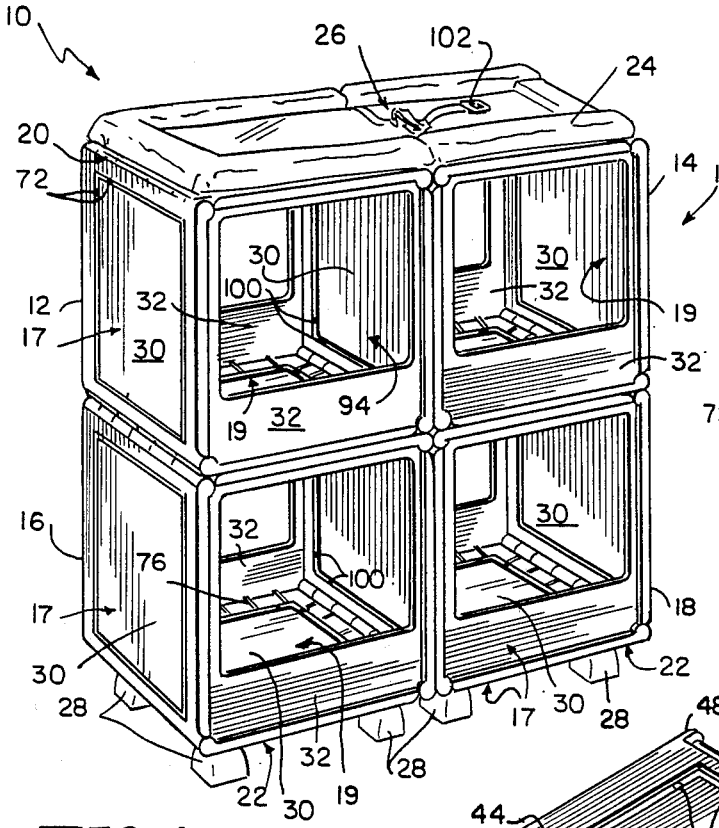
FIG. 1 is a perspective view of a modular dressing table of the present invention.

A modular dressing table 10 of the present invention is shown in FIG. 1. Table 10 includes a matrix element 11 of four identical hollow rectangular-solid-shaped module assemblies 12, 14, 16, 18 arranged and affixed in a two-by-two matrix. The top surface 20 of the dressing table 10 is defined by exterior surface 17 of the top rectangular panels 30 of the two upper horizontally adjacent assemblies 12, 14 in the matrix element 11. The bottom surface 22 of the dressing table 10 is defined by the exterior surface 17 of the bottom rectangular panels 30 of the two lower horizontally adjacent assemblies 16, 18 in the matrix element 11. A pad 24 and a restraining belt 26 are affixed to the top surface 20 of the dressing table 10 for infant comfort and safety respectively. Table supporting feet 28 are affixed to the bottom surface 22 of the dressing table at each corner of the two lower horizontally adjacent assemblies 16, 18 in matrix element 11.

Figure 2:
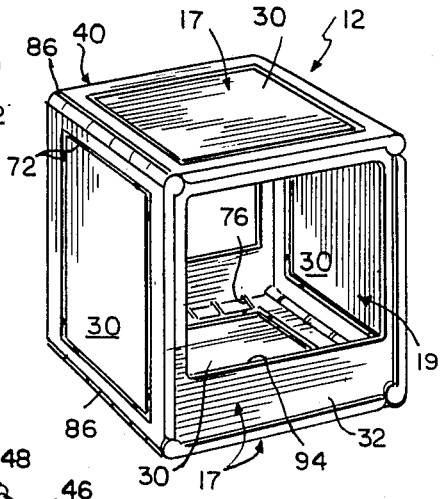
FIG. 2 is an enlarged perspective view of one of the four module assemblies used to form the matrix element of the dressing table in FIG. 1.
Figure 3:
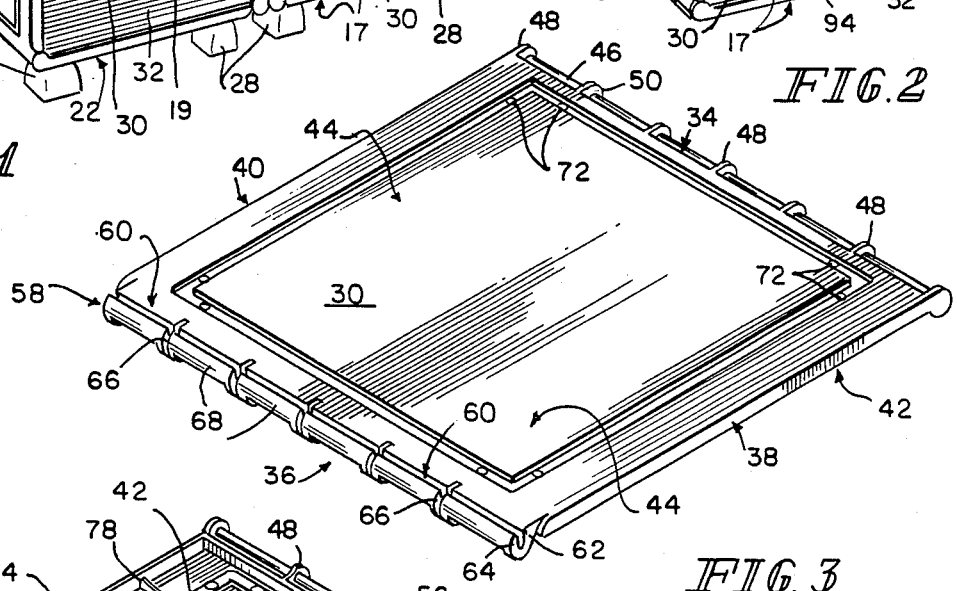
FIG. 3 is a perspective view of one of four identical panels used to construct the assembly shown in FIG. 2 showing the side forming part of the outside surface of the assembly.
Figure 4:
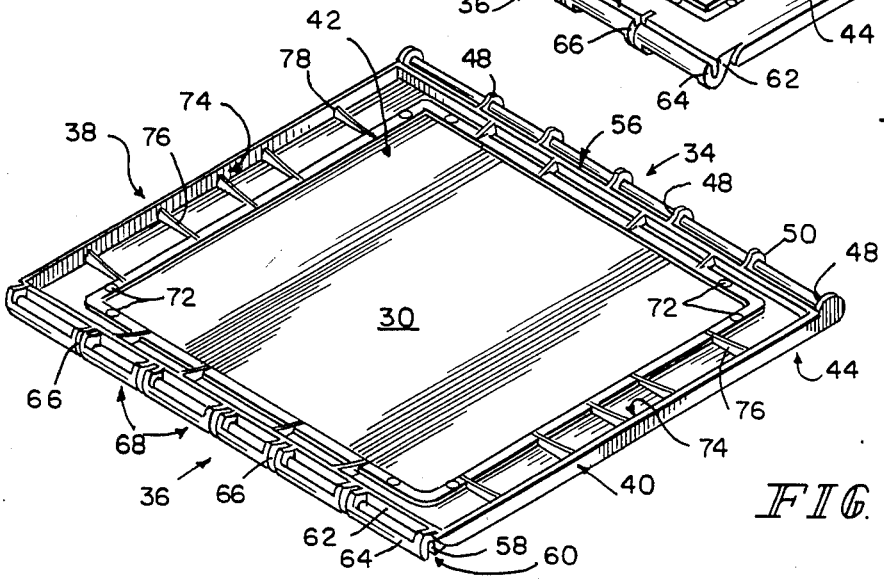
FIG. 4 is a perspective view of the panel shown in FIG. 3 from the opposite side.

As shown in FIG. 2 the rectangular-solid-shaped module assembly 12 has exterior surface 17 and interior surface 19. The module assembly 12 is formed from four identical hingedly connected rectangular panels 30 and two panel support members 32.

Referring to FIGS. 3–6, rectangular panel 30 has a first panel engaging edge 34 and second opposite panel engaging edge 36, a third lateral edge 38 and a fourth opposite lateral edge 40, and a first side 42 and second opposite side 44. A hinge post 46 is formed at the first panel engaging edge 34 of each rectangular panel 30. The hinge post 46 is supported by at least two (seven are shown) hinge post support struts 48 in a position substantially parallel to and spaced apart from the first edge 34 of the rectangular panel 30.

Extension 50 of each hinge post support strut 48 beyond the hinge post 46 is formed to have at least two channel insert receiving surfaces 52, 54 (best shown in FIG. 6), the function of which is detailed hereinbelow. Hinge post support struts 48, hinge post 46 and first panel edge 34 collectively define one or more channel wall receiving slots 56 along the first edge 34 of the rectangular panel 30.

Second panel engaging edge 36 of each rectangular panel 30 is formed as a hinge post receiving channel 58. Channel 58 has a channel opening 60, a panel proximal wall 62, and a panel distal wall 64. The channel opening 60 opens to the second side 44 of rectangular panel 30 and is sized to receive the hinge post 46 of another panel. Hinge post receiving channel 58 is interrrupted along its length by at least two hinge post strut receiving slots 66 traversing the channel 58 at points in lateral alignment with the hinge post support struts 48 on first edge 34 of rectangular panel 30. Hinge post receiving slots 66 define channel wall segments 68 which are engageable with the channel wall receiving slots 56 along the first edge 34 of another rectangular panel 30. Panel proximal wall 62 and panel distal wall 64 of hinge post receiving channel 58 are each formed to have a channel insert receiving surface 70 at the channel opening 60. Channel insert receiving surfaces 70 are best shown in FIGS. 5, 6, 7 and 10.

Rectangular panels 30 are provided with uniformly positioned affixing means receiving holes 72.

A panel support member receiving surface 74 is formed at each of the third and fourth lateral edges 38, 40 respectively, on first side 42 of the rectangular panels 30. A plurality of wedge-shaped ribs 76 positioned perpendicular to and contacting the panel support member receiving surfaces 74 are also located on first side 42 of each panel 30. A notch 78 (See FIG. 11) is located in each rib 76 immediately adjacent to panel support member receiving surface 74. Ribs 76 serve not only to provide support to support member receiving surface 74 but also, as discussed hereinbelow, cooperate with support member receiving surface 74 to hold panel support member 32 in a closely spaced relationship with the panel support member receiving surface 74 in module assembly 12. The second side 44 of rectangular panels 30, which form the exterior surface 17 of the assemblies 12, is formed as a flat-finished surface adapted to receive, for example, decals or other decorative ornamentation.

Figure 5:
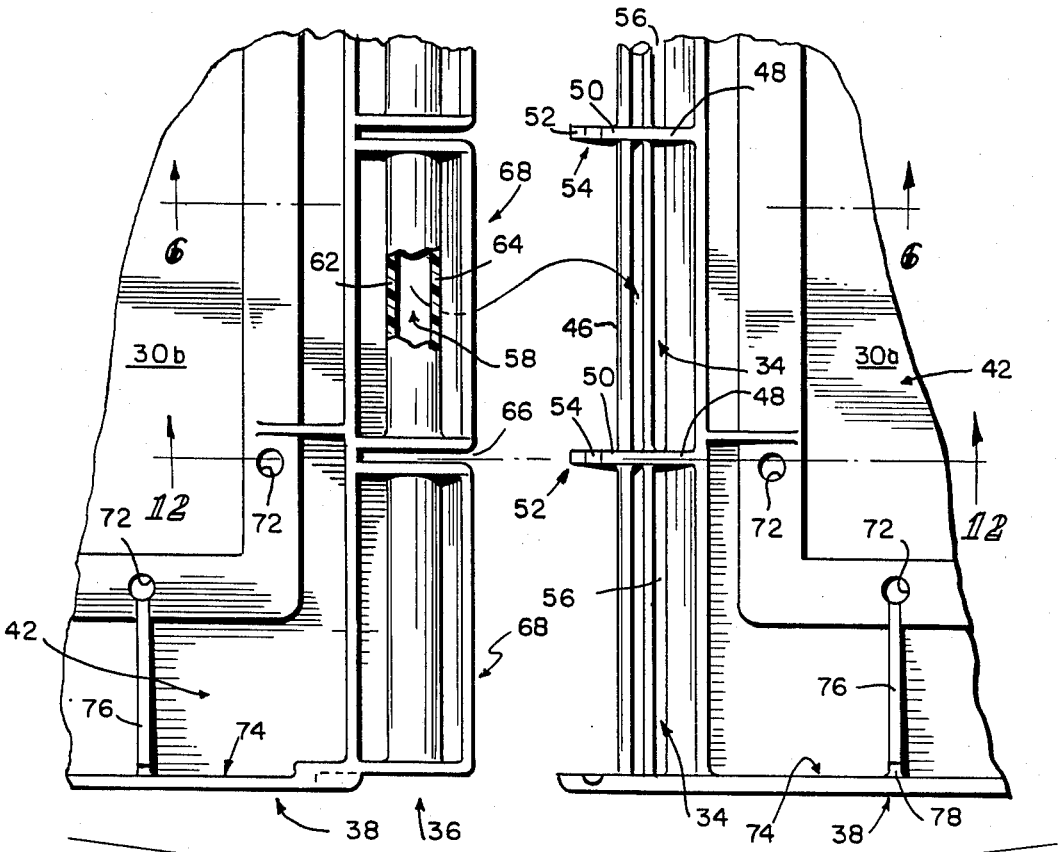
FIG. 5 is an enlarged, broken away, plan view of two adjacent panels viewed from the panel side shown in FIG. 4.
Figure 6:
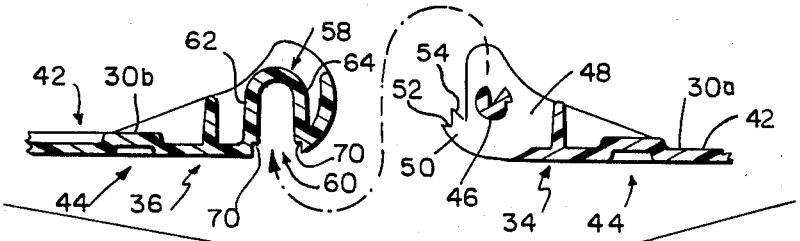
FIG. 6 is a cross-sectional view of the panels shown in FIG. 5 taken along line 6—6.
Figure 7:
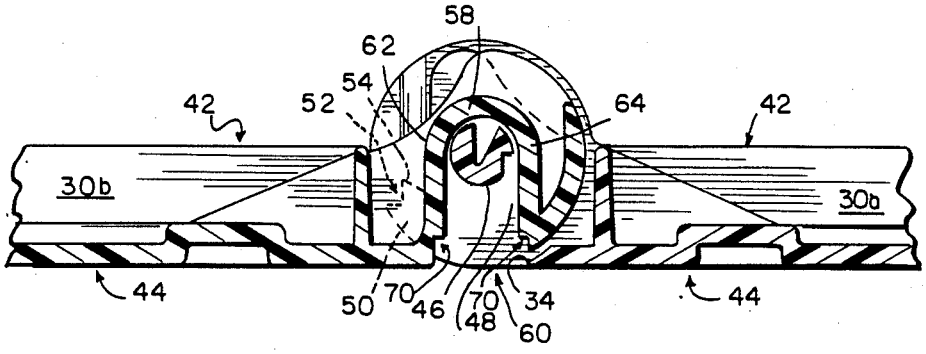
FIG. 7 is similar to FIG. 6 showing the panels engaged according to the dotted-line representation in FIG. 6.

Referring particularly to FIGS. 5–7, any two rectangular panels 30*a* and 30*b* can be hingedly connected by positioning the hinge post 46 of a first panel 30*a* adjacent to the hinge post receiving channel 58 of another panel 30*b*, aligning the adjacent lateral edges 40 of said panels 30*a*, 30*b* and inserting hinge post 46 of panel 30*a* into receiving channel 58 of panel 30*b* so that both hinge post 46 and hinge post receiving channel 58 have a substantially common axis. When rectangular panel 30*a* is rotated about the common axis of the hinge post 46 and channel 58 to bring the first sides 42 of the panels 30 in a more proximal relationship, hinge post support struts 48 of the panel 30*a* are fully engaged with hinge post strut receiving slots 66 of panel 30*b*. Concomitantly channel wall segments 68 of panel distal wall 64 of hinge post receiving channel 58 on panel 30*b* is engaged with the channel wall receiving slots 56 on the panel engaging edge 34 of rectangular panel 30*a*.

Figure 14:
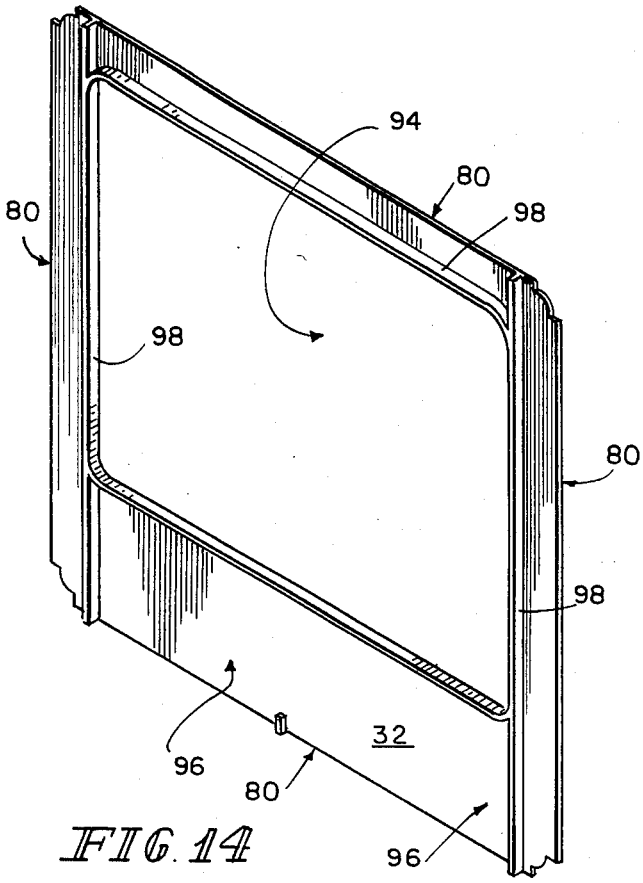
FIG. 14 is a perspective backside view of a panel support member.

As is illustrated in FIG. 14 panel support member 32 is of general rectangular shape. It is formed to have an aperture 94 sized to allow user access to the interior 19 of assembly 12 (See FIG. 2) when the panel support member 32 is positioned against the support member receiving surfaces 74 of the hingedly connected panels 30. The support member 32 is also formed to have support ribs 98 running parallel and spaced apart from the edges 80 of the support member 32. The ribs 98 are located on the backside 96 of support member 32 and provide added strength and rigidity to support member 32.

Figure 8:
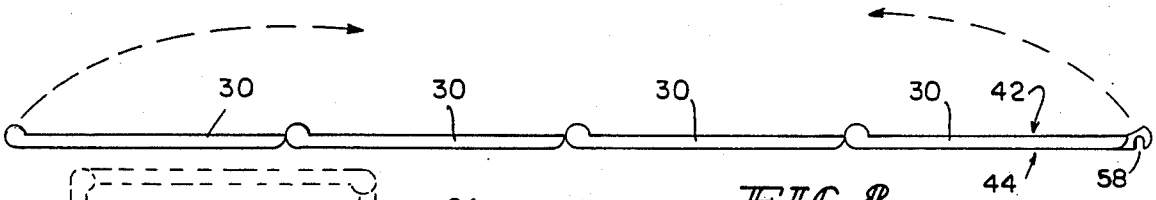
FIG. 8 is a side elevational view of four of the panels shown in FIG. 4 engaged in layout position.
Figure 9:
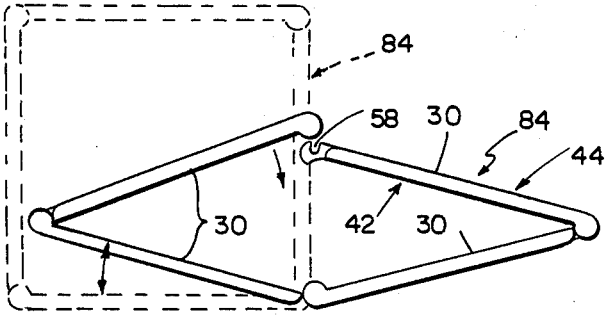
FIG. 9 is a view similar to FIG. 8 showing engagement of the two end panels of the panel layout illustrated in FIG. 8 and a dotted-line representation of said engaged panels racked to a perpendicular relationship.

Module assembly 12 is constructed from four rectangular panels 30 and two panel support members 32. Four rectangular panels 30 are hingedly engaged, the hinge post 46 of each panel 30 with the hinge post receiving channel 58 of another, as illustrated in FIGS. 8–9, to form an assembly 84 of four rectangular panels 30 hingedly connected. First sides 42 of panels 30 collectively define the interior of hingedly connected panel assembly 84. Second sides 44 of said hingedly connected panels 30 define the exterior of said assembly 84.

Figure 11:
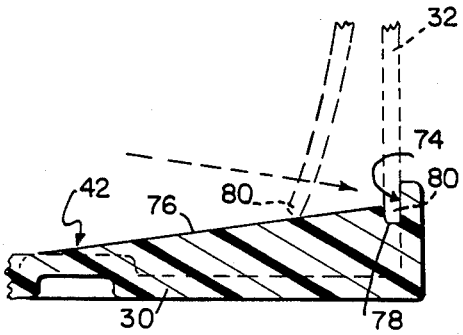
FIG. 11 is a cross-sectional view of FIG. 10 taken along line 11—11.
Figure 10:
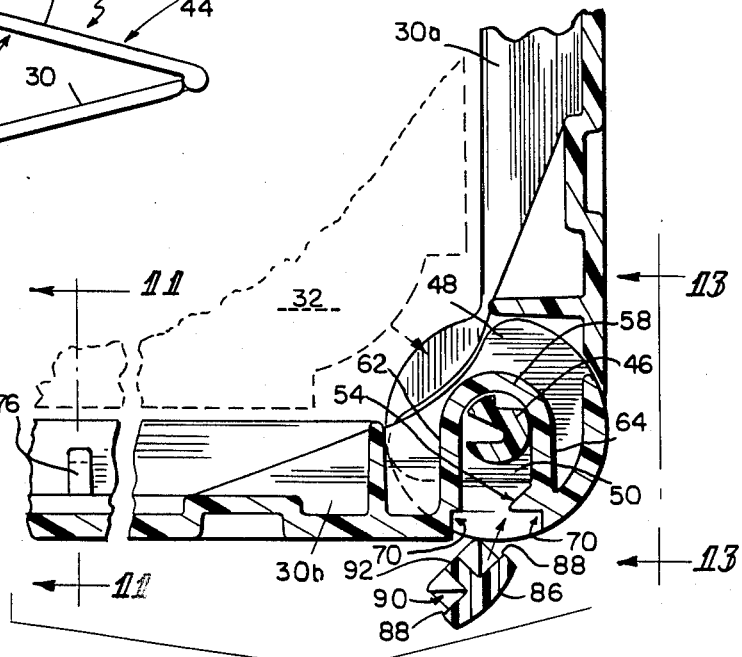
FIG. 10 is similar to FIG. 7 showing the panels rotated to a perpendicular position and showing positioning of the channel insert.
Figure 13:
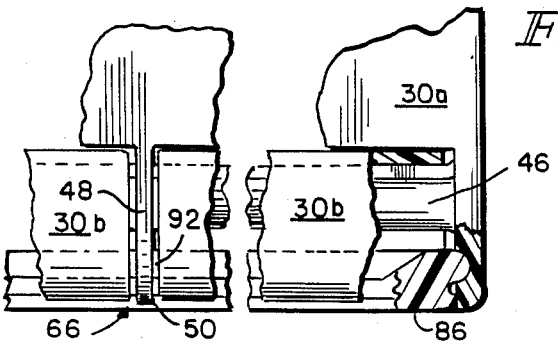
FIG. 13 is an end view of FIG. 10 taken from line 13—13, partially cross-sectioned and broken away.

The positioning of support panels 32 is best shown generally in FIG. 2 and detailed in FIGS. 10–11. Two panel support members 32, each sized to contact the support member receiving surfaces 74 at the respective third and fourth lateral edges of the hingedly connected panels 30, are positioned against the support member receiving surfaces 74 of the hingedly connected panels 30 to hold adjacent panels 30 in a perpendicular relationship. In practice positioning panel support members 32 is accomplished by racking hingedly connected panel assembly 84 (FIGS. 8–9) until adjacent hingedly connected rectangular panels 30 are approximately perpendicular. A panel support member 32 is inserted into the substantially rectangularly-shaped open end of the hingedly connected panel assembly 84, positioned parallel to the support member receiving surfaces 74 at the aligned lateral edges 38, 40 of the hingedly connected panels 30. As best illustrated in FIG. 11 the edges 80 of the panel support member 32 are brought into contact with the wedge-shaped ribs 76 adjacent to the support panel receiving surfaces 74 and ramped up the ribs 76 into notch 78 and into contact with the support member receiving surfaces 74 of the hingedly connected panels 30. The notch 78 is formed on each rib 76 immediately adjacent to the support member receiving surface 74 and is sized to receive the edge 80 of the panel support member 32. The notch 78 functions to hold the panel support member 32 in a closely spaced relation with the suppor member receiving surface 74. Construction of module assembly 12 is completed by positioning another panel support member 32 against the support member receiving surfaces 74 at the opposite aligned lateral edges of hingedly connected rectangular panels 30.

Figure 12:
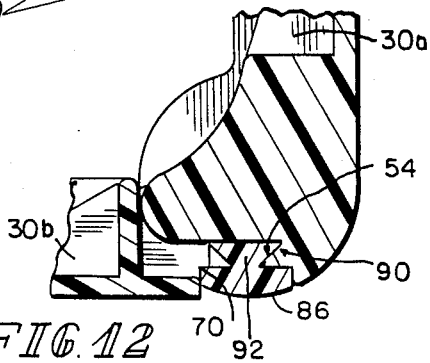
FIG. 12 is a view similar to FIG. 10 along line 12—12 of FIG. 5.

As described above, the channel opening 60 of the hinge post receiving channel 58 opens to the second side 44 of the hingedly connected rectangular panels 30 which form the exterior surface 17 of module assembly 12. The channel openings 60 are therefore exposed on the exterior 17 of module assembly 12 at the panel engaging edge 36 of the hingedly connected panels 30. Channel opening engaging inserts 86 (See FIGS. 10, 12) are provided to cover the exteriorly exposed channel openings 60.

Both the panel proximal wall 62 and the panel distal wall 64 of each hinge post receiving channel 58 is formed at the channel opening 60 to have a channel insert receiving surface 70. In addition, the extension 50 of hinge post struts 48 of each hingedly connected panel 30 are formed with two channel insert receiving surfaces 52, 54. Channel insert receiving surface 52 on strut extension 50 is positioned on said extension 50 so that it is in alignment with channel insert receiving surface 70 formed on panel distal wall 64 of hinge post receiving channel 58 when adjacent hingedly connected panels 30 are positioned in a substantially perpendicular relationship. Channel insert receiving surface 54 on hinge post strut extension 50 is of angular cross-section and is positioned on said extension 50 to engage hinge post engaging surface 90 of complementary angular cross-section on the channel opening engaging insert 86.

The insert 86 is formed to engage the channel insert receiving surfaces 70 at the channel opening 60 and the channel insert engaging surfaces 52, 54 on each hinge post strut extension 50. Insert 86 is sized to cover channel opening 60 and is formed to have a channel opening engaging surface 88 complementary to channel insert receiving surface 70 located on channel walls 62, 64 at channel opening 60. Positioned along the length of the channel insert 86 and spaced for alignment with the hinge post struts 48 and strut extensions 50 are hinge post engaging tabs 92 bearing the hinge post engaging surfaces 90 of angular cross-section complementary to the angular insert receiving surfaces 54 on each strut extension 50.

The channel opening engaging insert 86 is installed on the channel opening 60 of each rectangular panel 30 in module assembly 12. The insert 86 is installed on the channel insert receiving surface 70 by aligning the ends of the insert 86 with the lateral edges 38, 40 of the rectangular panel 30, aligning complementary respective channel opening engaging surface 88 and channel insert receiving surface 70 and applying pressure to insert 86 to engage the complementary surfaces 54 and 90 of angular cross-section on the hinge post strut extension 50 and the channel opening engaging insert 86 respectively. Preferably the channel insert 86 is installed in the channel opening 60 by first positioning the channel insert 86 on the channel insert receiving surface 70 so that the hinge post engaging surfaces 90 of angular cross-section on the insert 86 are immediately adjacent to the respective complementary surfaces of angular cross-section 54 on the hinge post strut extensions 50. The insert is then slid longitudinally into a position where each of the complementary surfaces 90, 54 of angular cross-section on the insert 86 and the hinge post strut extension 50, respectively, are engaged. The engagement of channel insert receiving surface 54 and hinge post engaging surface 90 holds the channel opening engaging insert 86 in a closely spaced relation with the complementary channel insert receiving surface 70. In addition, the engagement of the channel insert 86 with the channel insert receiving surfaces 70 and the channel insert receiving surfaces 52, 54 cooperates with the panel support members 32 to provide mechanical resistance to racking of the module assembly 12.

Figure 15:
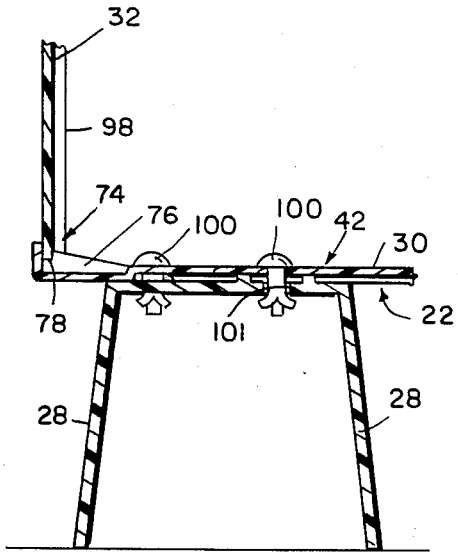
FIG. 15 is a transverse sectional view of one foot as it is affixed to the bottom of the dressing table shown in FIG. 1.

Rectangular-solid-shaped module assemblies 12 constructed from the hingedly connected rectangular panels 30 and panel support members 32 can be used individually as stand-alone juvenile furniture items or they can be arranged in a matrix configuration or simply in a horizontally or vertically adjacent relationship to meet various juvenile furnishing and storage needs. When two or more of said assemblies are used in combination in an adjacent relationship, especially a vertical adjacent relationship, it is preferred that each assembly 12 is secured to adjacent assemblies. This can be accomplished by aligning the affixing means receiving holes 72 in the rectangular panels 30 of adjacent assemblies 12 and inserting affixing means. Preferably the affixing means is of the type which can be readily removed when the user desires to change the assembly configuration. A preferred affixing means is a snap rivet 100 which is used in the construction of modular dressing table 10 of the present invention to affix the table feet 28 to the bottom surface 22 of the dressing table 10 (See FIG. 15). Preferably the table feet 28 are formed to have affixing means receiving holes 101 which can be aligned with the uniformly positioned affixing means receiving holes 72 in the rectangular panels 30 forming the bottom surface 22 of the dressing table.

Figure 16:
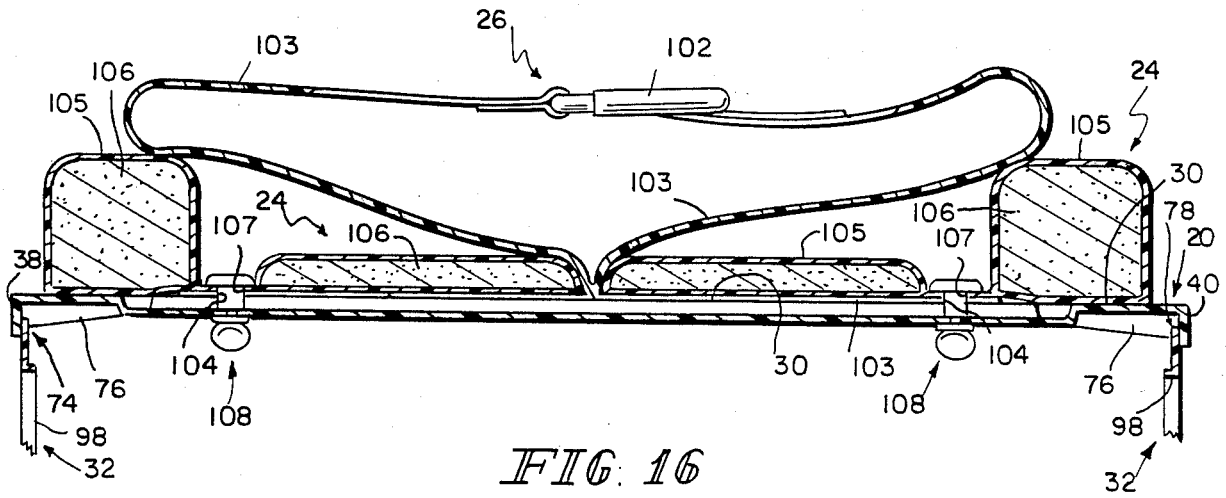
FIG. 16 is a transverse sectional view of the pad and restraint assembly at the top of the dressing table shown in FIG. 1.

The hingedly connected rectangular panels 30 and support members 32 used to construct the present module assembly 12, as well as the above-referenced table support feet 28, are constructed of a rigid synthetic or semi-synthetic polymeric material, preferably high impact polystyrene or high density polyethylene Referring to FIGS. 1 and 16, restraint belt 26 and pad 24 are affixed to the top surface of the dressing table 10 formed by the top rectangular panels 30 of the upper two horizontally adjacent module assemblies 12, 14 in the matrix element 11. The restraint belt 26 is of a standard construction, typically having a buckle 102 affixed to polymeric webbing material 103. The belt 26 is provided with affixing means receiving holes 104 that can be aligned with affixing means receiving holes in the top adjacent rectangular panels 30 of the matrix element 11. The pad 24 is likewise of standard construction having a vinyl covering 105 over a resilient foam filler 106. The pad is formed to have affixing means receiving holes 107 which can be aligned with the affixing means receiving holes 72 in the rectangular panels 30 forming the top surface 20 of the dressing table 10. Both the pad 24 and the restraint belt 26 are affixed to the rectangular panels forming the top surface 20 of dressing table 10 using button and thumb screw assembly 108 as shown in FIG. 16.

Although the invention has been described in detail with reference to a preferred embodiment illustrated in the drawings, variations and modifications exist within the scope and spirit of the invention as described and defined in the following claims.

We claim:

1. A modular dressing table for an infant having a top surface and a bottom surface, said dressing table comprising an infant restraining means and cushion means for infant comfort affixed to the top surface;

a matrix of individual hollow modular assemblies, each assembly consisting essentially of four identical rectangular panels engaged to form a construction having four rectangular walls hingedly connected and means for engaging said construction to hold each panel rigidly in a position perpendicular to the adjacent panels engaged therewith, each rectangular panel having first and second opposite surfaces, first and second opposite panel engaging edges, and third and fourth opposite lateral edges, said first panel engaging edge being formed as a first connector and said second panel engaging edge being formed as a second connector, said first connector being formed as a hinge post supported in a position substantially parallel and spaced apart from the first edge of the rectangular panel by at least two hinge post support struts, said struts, hinge post and panel edge collectively defining one or more channel wall receiving slots along the first edge of the rectangular panels, said second connector being formed as a hinge post receiving channel having a channel opening, a panel proximal wall, and a panel distal wall, said channel opening toward the second surface of said rectangular panel and sized to receive the hinge post of another of the four rectangular panels, said channel being interrupted along its length by at least two hinge post strut receiving slots traversing the channel at points in alignment with the hinge post support struts of the first connector of said rectangular panels, said hinge post receiving slots defining channel wall segments engageable with the channel wall receiving slots along the first edge of the rectangular panels, said first connector of each rectangular panel being rotatably engageable with the second connector formed at the edge of a second rectangular panel to hingedly connect said rectangular panels along their respective first and second edges, whereby, when said panels are connected by engaging the first edge of each panel with the second edge of another, the panels form a construction having rectangular walls hingedly connected, the first surfaces of said panels forming the interior of said construction and the second surfaces forming the exterior of said construction, said means for engaging said construction to hold each panel rigidly in a position perpendicular to adjacent panels connected therewith comprising a support member sized to engage at least two of the four rectangular panels and means for securing said support member to said rectangular panel, and wherein, in each assembly, the channel opening at the second edge of each hingedly connected rectangular panel is formed to have a channel insert receiving surface adapted to receive a channel opening engaging insert having a channel opening engaging surface complementary to the channel insert receiving surface and wherein in each assembly the hinge post support struts of each hingedly connected panel are provided with a channel insert receiving surface positioned to engage the channel opening engaging surface of the channel opening engaging insert when said insert is positioned to engage the channel opening, whereby said insert provides mechanical resistance to racking of said assemblies.

2. The modular dressing table of claim 1 wherein the lateral edges of the first side of each of hingedly connected rectangular panels used to form the modular assemblies have a panel support member receiving surface and a means for engaging the support member cooperatively positioned with said support member receiving surface, and wherein two panel support members are used for each assembly, one support member positioned against the support member receiving surface at each of the third and the fourth aligned opposite lateral edges of the hingedly connected rectangular panels and wherein at least one of the panel support members positioned in each assembly has an aperture sized to allow user access to the interior space of the assembly.

3. The assembly of claim 2 wherein the hingedly connected rectangular panels are provided with means for securing two or more of said assemblies in a horizontally or vertically adjacent relationship.

4. An assembly for use in constructing a furniture item comprising four identical rectangular panels, each panel having first and second opposite sides, first and second opposite panel engaging edges, and third and fourth opposite lateral edges, said first panel engaging edge being formed as a hinge post supported in a position substantially parallel and spaced apart from the edge of the rectangular panel by at least two hinge post support struts, said struts, hinge post and panel edge collectively defining one or more channel wall receiving slots along the first edge of the rectangular panel, and said second panel engaging edge being formed as a hinge post receiving channel having a channel opening, a panel proximal wall, and a panel distal wall, said channel opening toward the second side of said rectangular panel and sized to receive the hinge post of another of the four rectangular panels, said channel being interrupted along its length by at least two hinge post strut receiving slots traversing the channel at points in alignment with the hinge post support struts on the first edge of said rectangular panel, said hinge post receiving slots defining channel wall segments engageable with the channel wall receiving slots along the first edge of another of the rectangular panels, said hinge post of each rectangular panel being rotatably engageable with the hinge post receiving channel formed at the edge of a second rectangular panel to hingedly connect said rectangular panels along their respective first and second edges, whereby, when said four panels are connected by engaging the first edge of each panel with the second edge of another, the panels form a construction having rectangular walls hingedly connected, the first surfaces of said panels forming the interior of said construction and the second surfaces forming the exterior of said construction; and means for engaging said construction to hold each panel rigidly in a position perpendicular to the panels engaged therewith, said means being two panel support members, each sized to engage the four hingedly connected rectangular panels proximal to their lateral edges, said lateral edges having a panel support member receiving surface and means for engaging said support member cooperatively positioned with said support member receiving surface to hold said support member in a close relation with said support member receiving surface, at least one of the panel support members or the hingedly connected panels having an aperture which allows access to the interior space of the modular assembly when said support members are in place proximal to the lateral edge of the hingedly connected rectangular panels, in which modular assembly the opening of hinge post receiving channel of each hingedly connected rectangular panel is formed as a channel insert receiving surface and wherein said means for engaging said hingedly connected panels to hold each panel rigidly in a position perpendicular to the panels connected therewith further comprises channel opening engaging inserts, each of which is provided with a channel opening engaging surface and a hinge post strut engaging surface whereby when said channel engaging inserts are positioned against the respective channel insert receiving surfaces, said inserts cooperate with the support members to provide mechanical resistance to racking of said assembly.

5. A modular dressing table for an infant having a top surface and a bottom surface, said dressing table comprising an infant restraining means and cushion means for infant comfort affixed to the top surface; and a matrix of individual hollow module assemblies, each assembly comprising four retangular panels, each panel having first and second opposite surfaces, first and second opposite panel engaging edges, and third and fourth opposite lateral edges, said first panel engaging edge being formed as a first connector means and said second panel engaging edge being formed as a second connector means, said first connector means of each rectangular panel rotatably interlocking the second connector means formed at the edge of a like second rectangular panel to establish a detachable two-piece hinged connection between each pair of adjacent rectangular panels along their respective first and second edges, whereby, when said panels are connected by engaging the first edge of each panel with the second edge of another, the panels form a construction having rectangular walls hingedly connected, the first surfaces of said panels forming the interior of said construction and the second surfaces forming the exterior of said construction; and means for engaging said construction to hold each panel rigidly in a fixed position relative to adjacent panels hingedly connected therewith; each assembly being secured to each adjacent assembly in said matrix, each module assembly consisting essentially of four identical rectangular panels engaged to form a construction having four rectangular walls hingedly connected and means for engaging said construction to hold each panel rigidly in a position perpendicular to the adjacent panels engaged therewith, whereby said assembly has six rectangular sides, said four hingedly connected rectangular panels forming four of said six sides and the opposite lateral edges of said panels defining the perimeter of the fifth and sixth sides of said assembly, said means for engaging said hingedly connected rectangular panels to hold each panel rigidly in a position perpendicular to adjacent panels connected therewith comprising a support member sized to engage at least two of the four rectangular panels and means for securing said support member to said rectangular panels, and the lateral edges of the first side of each hingedly connected rectangular panels having a panel support member receiving surface and means for engaging the support member cooperatively positioned with said support member receiving surface to hold said support member in a closely spaced relationship with said support member receiving surface.

6. An assembly for use in constructing a furniture item comprising four rectangular panels, each panel having first and second opposite surfaces, first and second opposite panel engaging edges, and third and fourth opposite lateral edges, said first panel engaging edge being formed as a first connector means and said second panel engaging edge being formed as a second connector means, said first connector means of each rectangular panel rotatably interlocking the second connector means formed at the edge of a second rectangular panel to establish a detachable two-piece hinged connection between each pair of adjacent rectangular panels along their respective first and second edges, whereby, when said panels are connected by engaging the first edge of each panel with the second edge of another, the panels form a construction having rectangular walls hingedly connected, the first surfaces of said panels forming the interior of said construction and the second surfaces forming the exterior of said construction; and means for engaging said construction to hold each panel rigidly in a fixed position relevant to adjacent panels hingedly connected therewith, the connector at the first panel engaging edge of each rectangular panel being formed as a hinge post supported in a position substantially parallel and spaced apart from the edge of the rectangular panel by at least two hinge post support struts, said struts, hinge post, and panel edge collectively defining one or more channel wall receiving slots along the first edge of the rectangular panel, the connector at the second edge of each rectangular panel being formed as a hinge post receiving channel having a channel opening, a panel proximal wall, and a panel distal wall, said channel opening to the second side of said rectangular panel and sized to receive the hinge post of another of the four rectangular panels, said channel being interrupted along its length by at least two hinge post strut receiving slots traversing the channel at points in alignment with the hinge post support struts on the first edge of said rectangular panels, said hinge post receiving slots defining channel wall segments engageable with the channel wall receiving slots along the first edge of the rectangular panels, whereby any two of the four panels can be hingedly connected by placing the first edge of a first panel adjacent to the second edge of a second panel, aligning the third and fourth edges of said panels, and inserting the hinge post of the first panel into the opening of the hinge post receiving channel of the second panel so that both the hinge post and the hinge post receiving channel have a substantially common axis, and rotating one or both panels about the common axis of the hinge post and channel to bring the first sides of the panels in a more proximal relationship thereby fully engaging the hinge post support struts of the first panel with the strut receiving slots in the hinge post receiving channel of the second panel and concomitantly engaging the segments of the panel distal walls of the hinge post receiving channel on the second panel with the channel wall receiving slots along the first edge of the first rectangular panel, the hinge post receiving channel of each hingedly connected rectangular panel being formed as a channel insert receiving surface, said means for engaging said hingedly connected panels to hold each panel rigidly in a position perpendicular to the panels connected therewith further comprising channel opening engaging inserts, each of which is provided with a channel opening engaging surface and a hinge post strut engaging surface whereby when said channel engaging inserts are positioned against the respective channel insert receiving surfaces, said inserts cooperating with the support members to provide mechanical resistance to racking of said assembly.

7. An assembly for use in constructing a furniture item comprising four rectangular panels, each panel having first and second opposite surfaces, first and second opposite panel engaging edges, and third and fourth opposite lateral edges, said first panel engaging edge being formed as a first connector means and said second panel engaging edge being formed as a second connector means, said first connector means of each rectangular panel rotatably interlocking the second connector means formed at the edge of a second rectangular panel to establish a detachable two-piece hinged connection between eah pair of adjacent rectangular panels along their respective first and second edges, whereby, when said panels are connected by engaging the first edge of each panel with the second edge of another, the panels form a construction having rectangular walls hingedly connected, the first surfaces of said panels forming the interior of said construction and the second surfaces forming the exterior of said construction; and means for engaging said construction to hold each panel rigidly in a fixed position relevant to adjacent panels hingedly connected therewith, the connector at the first panel engaging edge of each rectangular panel being formed as a hinge post supported in a position substantially parallel and spaced apart from the edge of the rectangular panel by at least two hinge post support struts, said struts, hinge post, and panel edge collectively defining one or more channel wall receiving slots along the first edge of the rectangular panel, the connector at the second edge of each rectangular panel being formed as a hinge post receiving channel having a channel opening, a panel proximal wall, and a panel distal wall, said channel opening to the second side of said rectangular panel and sized to receive the hinge post of another of the four rectangular panels, said channel being interrupted along its length by at least two hinge post strut receiving slots traversing the channel at points in alignment with the hinge post support struts on the first edge of said rectangular panels, said hinge post receiving slots defining channel wall segments engageable with the channel wall receiving slots along the first edge of the rectangular panels, any two of the four panels being hingedly connectable by placing the first edge of a first panel adjacent to the second edge of a second panel, aligning the third and fourth edges of said panels, and inserting the hinge post of the first panel into the opening of the hinge post receiving channel of the second panel so that both the hinge post and the hinge post receiving channel have a substantially common axis, and rotating one or both panels about the common axis of the hinge post and channel to bring the first sides of the panels in a more proximal relationship thereby fully engaging the hinge post support struts of the first panel with the strut receiving slots in the hinge post receiving channel of the second panel and concomitantly engaging the segments of the panel distal walls of the hinge post receiving channel on the second panel with the channel wall receiving slots along the first edge of the first rectangular panel, the hingedly connected rectangular panels being provided with means for securing two or more of said assemblies in a horizontally or vertically adjacent relationship.

* * * * *